US012492518B2

(12) United States Patent
Nagel et al.

(10) Patent No.: US 12,492,518 B2
(45) Date of Patent: Dec. 9, 2025

(54) ADJUSTING A SETTING OF A SCREED ASSEMBLY BASED ON TEMPERATURE DATA OF THE SCREED ASSEMBLY

(71) Applicants: Caterpillar Paving Products Inc., Brooklyn Park, MN (US); Holt Texas Ltd., San Antonio, TX (US)

(72) Inventors: Brian D. Nagel, Ramsey, MN (US); Brett Wayne Engel, Otsego, MN (US); John Richard Guzman, Lucas, TX (US)

(73) Assignees: Caterpillar Paving Products Inc., Brooklyn Park, MN (US); Holt Texas Ltd., San Antonio, TX (US)

( * ) Notice: Subject to any disclaimer, the term of this patent is extended or adjusted under 35 U.S.C. 154(b) by 714 days.

(21) Appl. No.: 17/816,227

(22) Filed: Jul. 29, 2022

(65) Prior Publication Data

US 2024/0035238 A1 Feb. 1, 2024

(51) Int. Cl.
*E01C 19/48* (2006.01)

(52) U.S. Cl.
CPC ..... *E01C 19/48* (2013.01); *E01C 2301/10* (2013.01); *E01C 2301/14* (2013.01)

(58) Field of Classification Search
CPC ..... E01C 19/288; E01C 19/42; E01C 19/48; E01C 23/14; E01C 2301/10; E01C 2301/14
See application file for complete search history.

(56) References Cited

U.S. PATENT DOCUMENTS

| | | | | |
|---|---|---|---|---|
| 6,334,735 | B1 * | 1/2002 | Williams | E01C 19/48 700/19 |
| 7,172,363 | B2 * | 2/2007 | Olson | E01C 19/48 404/75 |
| 7,217,062 | B2 * | 5/2007 | Pisano | E01C 19/48 404/95 |
| 9,200,415 | B2 | 12/2015 | Graham et al. | |
| 9,447,549 | B2 | 9/2016 | Buschmann et al. | |
| 9,556,569 | B2 * | 1/2017 | Oetken | E01C 19/08 |

(Continued)

FOREIGN PATENT DOCUMENTS

| | | | | |
|---|---|---|---|---|
| CN | 202007375 U | | 10/2011 | |
| JP | 2009287196 A | * | 12/2009 | |
| WO | WO-0047822 A1 | * | 8/2000 | E01C 19/48 |

OTHER PUBLICATIONS

Machine translation of JP 2009-287196 A obtained on Apr. 29, 2025.*

*Primary Examiner* — Adam D Rogers

(57) ABSTRACT

In some implementations, a controller may receive a command to adjust a setting of the screed assembly. The controller may obtain temperature data from one or more sensor devices of the screed assembly. The controller may determine, based on the temperature data, a corresponding temperature of one or more components of the screed assembly. The controller may selectively cause the setting to be adjusted or preventing the setting from being adjusted based on the corresponding temperature of the one or more components, the setting being adjusted based on determining that the corresponding temperature satisfies a temperature threshold, or the setting being prevented from being adjusted based on determining that the corresponding temperature does not satisfy the temperature threshold.

20 Claims, 3 Drawing Sheets

(56) References Cited

U.S. PATENT DOCUMENTS

| | | | | |
|---|---|---|---|---|
| 9,759,708 | B2 | 9/2017 | Marsolek et al. | |
| 9,777,445 | B1 * | 10/2017 | Engel | E01C 19/48 |
| 9,811,952 | B2 * | 11/2017 | Carlson | G07C 5/0841 |
| 10,053,822 | B2 * | 8/2018 | Eul | H04L 12/40 |
| 10,228,293 | B2 * | 3/2019 | Marsolek | E01C 19/48 |
| 10,280,572 | B1 * | 5/2019 | Thiesse | H05B 1/023 |
| 10,538,886 | B2 | 1/2020 | Buschmann et al. | |
| 10,669,678 | B2 * | 6/2020 | Marsolek | G01J 5/0859 |
| 10,753,051 | B2 | 8/2020 | Noll | |
| 11,060,247 | B2 * | 7/2021 | Schuette | E01C 19/48 |
| 11,306,447 | B2 * | 4/2022 | Berns | E01C 19/48 |
| 12,281,450 | B2 * | 4/2025 | Buschmann | E01C 19/4866 |
| 2014/0260751 | A1 * | 9/2014 | Graham | E01C 19/48<br>74/479.01 |
| 2016/0186389 | A1 * | 6/2016 | Graham | E01C 19/48<br>404/79 |
| 2024/0279885 | A1 * | 8/2024 | Hedrington | E01C 19/4853 |

* cited by examiner

ADJUSTING A SETTING OF A SCREED ASSEMBLY BASED ON TEMPERATURE DATA OF THE SCREED ASSEMBLY

TECHNICAL FIELD

The present disclosure relates generally to adjusting a setting of a screed assembly and, for example, to adjusting the setting of the screed assembly based on temperature data.

BACKGROUND

Paving machines (also referred to as road pavers) are commonly used to apply, spread, and/or compact a paving material mat (e.g., a mat of bituminous roadway material) relatively evenly over a work surface. These machines are generally used in the construction of roads, parking lots, and other areas. A typical paving machine employs a screed assembly (sometimes referred to as a floating screed) to lay the paving material mat.

A setting of the screed assembly (e.g., an angle of attack) may be preset and stored to enable the screed assembly to timely transition from a neutral state (or resting state) to the setting. Proper operation of the screed assembly requires a temperature of the screed assembly to reach a particular temperature. In this regard, causing the screed assembly to transition from the neutral state to the preset setting prior to the temperature (of the screed assembly) reaching the particular temperature may cause components of the screed assembly to wear prematurely, may cause damage to the components, may cause damage to the paving machine, among other examples.

For example, inducing a movement of a frame of the screed assembly or inducing a distortion of the frame (by changing the angle of attack), prior to the temperature of the screed assembly reaching the particular temperature, may damage the screed assembly. The frame may include one or more components of a primary screed of the screed assembly. Additionally, causing the screed assembly to transition from the neutral state to the preset setting prior to the temperature of the screed assembly reaching the particular temperature may cause the screed assembly to operate in a manner different than a manner in which the screed assembly performed when the setting was preset and stored.

U.S. Pat. No. 10,538,886 (the '886 patent) discloses that a road paver comprises a generator, a heating element, a control device, and a screed. The '886 patent further discloses that the screed comprises a basic screed and is suited to be modified, by selectively attaching or detaching broadening parts, from a first to at least a second, different screed configuration. While the '886 patent refers to different screed configurations, the '886 patent does not discuss the different screed configurations with respect to a temperature of the screed.

The system of the present disclosure solves one or more of the problems set forth above and/or other problems in the art.

SUMMARY

In some implementations, a method performed by a controller of a screed assembly includes receiving a command to adjust a setting of the screed assembly; obtaining temperature data from one or more sensor devices of the screed assembly; determining, based on the temperature data, a corresponding temperature of one or more components of the screed assembly; and selectively causing the setting to be adjusted or preventing the setting from being adjusted based on the corresponding temperature of the one or more components, the setting being adjusted based on determining that the corresponding temperature satisfies a temperature threshold, or the setting being prevented from being adjusted based on determining that the corresponding temperature does not satisfy the temperature threshold.

In some implementations, a controller includes one or more memories; and one or more processors configured to: receive a command to adjust a setting for operating a screed assembly of a machine; determine a corresponding temperature of one or more components of the screed assembly; determine whether the corresponding temperature satisfies a temperature threshold; and selectively cause the setting to be adjusted or prevent the setting from being adjusted based on determining whether the corresponding temperature satisfies the temperature threshold, the setting being adjusted based on determining that the corresponding temperature satisfies the temperature threshold, or the setting being prevented from being adjusted based on determining that the corresponding temperature does not satisfy the temperature threshold.

In some implementations, a screed assembly includes one or more sensor devices configured to generate temperature data indicating a corresponding temperature of one or more components of the screed assembly; and a controller configured to: receive a command to adjust a setting for operating the screed assembly; determine the corresponding temperature of the one or more components based on the temperature data; and selectively adjust the setting or prevent the setting from being adjusted based on the corresponding temperature of the one or more components, the setting being adjusted based on determining that the corresponding temperature is a first value, or the setting being prevented from being adjusted based on that the corresponding temperature is a second value that is different than the first value.

DETAILED DESCRIPTION

Implementations described herein relate to a system that selectively enables or disables an adjustment of a setting of a screed assembly based on a temperature of one or more components of the screed assembly. The one or more components may include one or more components of a primary screed of the screed assembly (e.g., a left main frame, a right main frame, and/or a main screed plate). In some examples, the setting of the screed assembly may be adjusted to enable the screed assembly to perform a task associated with the setting. In some situations, adjusting a setting of the screed assembly may cause the screed assembly to transition from a current setting to a preset setting (e.g., a setting caused to be stored by an operator of the screed assembly for subsequent use of the screed assembly).

In some examples, based on receiving a command to adjust the setting of the screed assembly, the system may determine whether the temperature satisfies a temperature threshold. In some situations, the temperature threshold may be associated with the preset setting. For example, the temperature threshold may be associated with a temperature of the one or more components, when the preset setting was set. The system may enable the setting to be adjusted based on the temperature satisfying the temperature threshold. Alternatively, the system may prevent the setting from being adjusted based on the temperature not satisfying the temperature threshold.

By controlling the adjustment of the setting of the screed assembly in this manner, the system may prevent a distortion (or a twisting) of the one or more components of the primary screed. Accordingly, by controlling the adjustment of the setting of the screed assembly in this manner, the system may prevent premature wear of the screed assembly, prevent damage to the screed assembly, prevent damage to a paving machine associated with the screed assembly, among other examples. Additionally, or alternatively, by controlling the adjustment of the setting of the screed assembly in this manner, the system may enable consistent performance, by the screed assembly, of the task associated with the preset setting.

The term "machine" may refer to a device that performs an operation associated with an industry such as, for example, construction. Moreover, one or more implements may be connected to the machine. As an example, a machine may include a construction vehicle, a work vehicle, or a similar vehicle associated with the industries described above.

Figure 1:
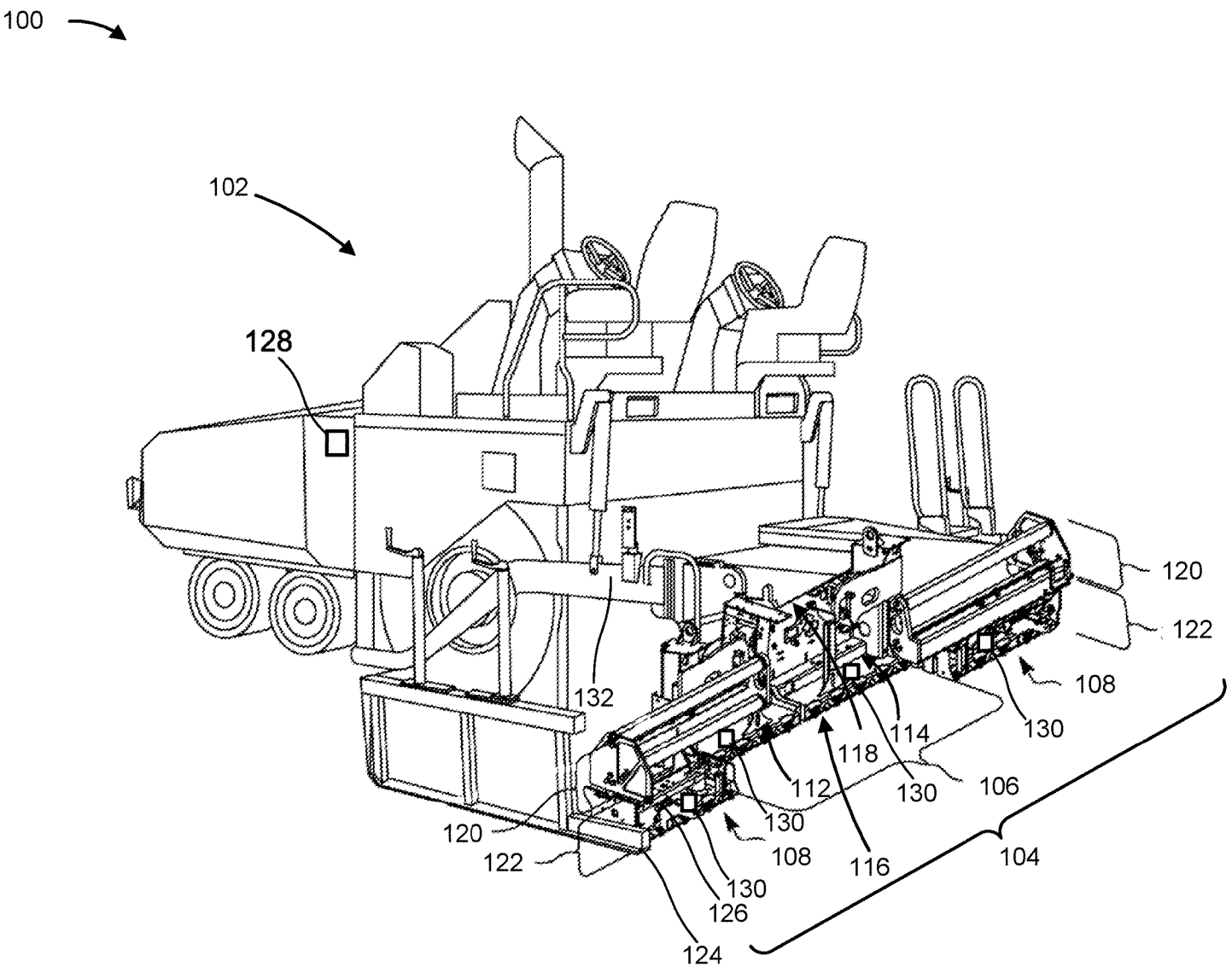
FIG. 1 is a diagram of an example machine described herein.

FIG. 1 is a diagram 100 relating to an example paving machine 102 that includes a screed assembly 104, a controller 128, and sensor devices 130. The paving machine 102 may be a road paver, an asphalt finisher, or a similar machine. As shown in FIG. 1, the screed assembly 104 may include a primary screed 106 and a pair of screed extensions 108 (e.g., that are disposed on opposite sides of the primary screed 106). Each screed extension 108 may be moveably coupled to the primary screed 106.

As shown in FIG. 1, primary screed 106 includes a left main frame 112, a right main frame 114, a main screed plate 116 (or primary screed plate), and a crown system 118. Crown system 118 may be configured to provide a link between left main frame 112 and right main frame 114. Additionally, or alternatively, crown system 118 may be configured to enable left main frame 112 and right main frame 114 to twist independently of each other.

As shown in FIG. 1, a screed extension 108 includes an upper frame 120, a lower frame 122, and a screed extension plate 124 that attaches to a lower edge of the lower frame 122. As further shown in FIG. 1, a set of linkage systems 126 may be used to connect upper frame 120 and lower frame 122. The set of linkage systems 126 may be adjusted to control a height of lower frame 122 (e.g., a distance between the lower edge of lower frame 122 and a work surface underneath the lower edge of lower frame 122) and/or an angle of attack of the lower frame 122 (e.g., an angle screed extension plate 124 that attaches to the lower edge of lower frame 122 makes when contacting the work surface). Additionally, or alternatively, the angle of attack may refer to an angle formed by primary screed 106 when contacting the work surface.

Controller 128 (e.g., an electronic control module (ECM)) may control and/or monitor operations of paving machine 102 and/or screed assembly 104. For example, controller 128 may control and/or monitor the operations of paving machine 102 and/or screed assembly 104 based on signals from operator controls (of paving machine 102 and/or of screed assembly 104) and/or from one or more sensor devices, as described in more detail below. The operator controls may include integrated joysticks, push-buttons, control levers, and/or steering wheels. In some situations, controller 128 may be electrically coupled to screed assembly 104 in order to control an adjustment of a setting of screed assembly 104.

Sensor devices 130 may include one or more devices capable of generating signals regarding a temperature of one or more components of screed assembly 104. For example, sensor devices 130 may generate temperature data indicating the temperature of the one or more components of screed assembly 104. The one or more components may include left main frame 112, right main frame 114, and/or main screed plate 116, among other components of screed assembly 104 such as upper frame 120, lower frame 122, and/or screed extension plate 126.

As shown in FIG. 1, screed assembly 104 may be connected to a frame of paving machine 102 by a set of screed support arms 132 (also referred to as tow arms). In some situations, screed support arms 132 may be substantially parallel and horizontal to one another, extending along the frame of paving machine 102. Screed support arms 132 may be pivotally connected to the frame of paving machine 102, thereby permitting vertical movement of screed assembly 104.

Independent vertical movements of each screed support arm 132 may induce a distortion (or a twisting) of primary screed 106 (e.g., a twisting of left main frame 112, a twisting of right main frame 114, and/or a twisting of main screed plate 116). Additionally, or alternatively, crown system 118 may induce the distortion of primary screed 106 (e.g., a twisting of left main frame 112 and/or a twisting of right main frame 114). Additionally, or alternatively, other components of screed assembly 104 may induce the distortion of primary screed 106. For example, thickness control screws (e.g., left hand thickness control screw and/or right hand thickness control screw) may induce the distortion of primary screed 106. The thickness control screws may be configured to adjust a thickness of a material processed by screed assembly 104. In some examples, the thickness control screws may be operated manually (e.g., by an operator of screed assembly 104). Alternatively, the thickness control screws may be operated automatically (e.g., operated without the operator of screed assembly 104).

Inducing the distortion (or the twisting) of primary screed 106, prior to a temperature of primary screed 106 satisfying a temperature threshold, may damage screed assembly 104 and/or primary screed 106. Accordingly, controller 128 may use temperature data from sensor devices 130 to control an adjustment of a setting of screed assembly 104 and thereby prevent the distortion (or the twisting) of primary screed 106 prior to the temperature of primary screed 106 satisfying the temperature threshold.

As indicated above, FIG. 1 is provided as an example. Other examples may differ from what is described in connection with FIG. 1.

Figure 2:
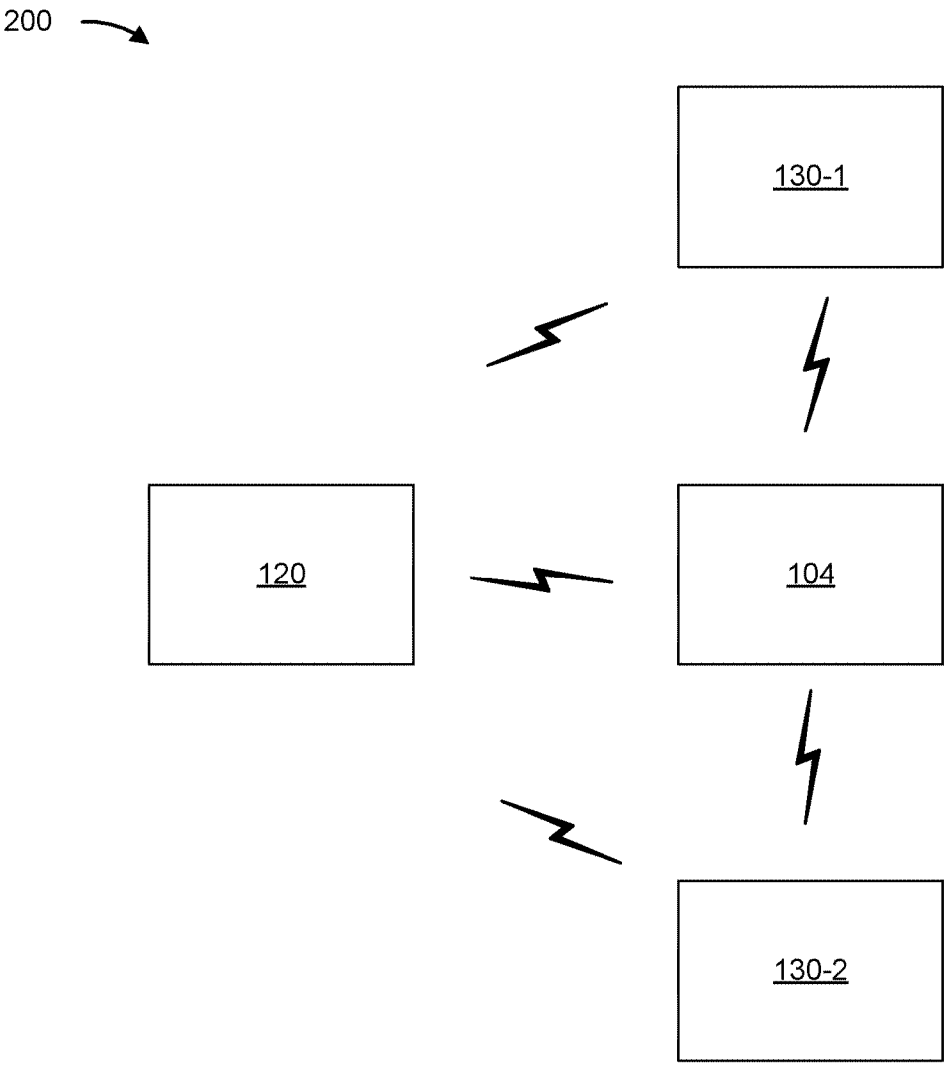
FIG. 2 is a diagram of an example system described herein.

FIG. 2 is a diagram of an example system 200 described herein. As shown in FIG. 2, system 200 includes screed assembly 104, controller 128, and a sensor device 130-1 and a sensor device 130-2 (collectively referred to as "sensor devices 130"). Screed assembly 104 has been described above in connection with FIG. 1.

Controller 128 may include a processor and a memory. The processor may be implemented in hardware, firmware, and/or a combination of hardware and software. The processor includes a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), and/or another type of processing component. The processor may be capable of being programmed to perform a function.

The memory includes a random-access memory (RAM), a read only memory (ROM), and/or another type of dynamic or static storage device (e.g., a flash memory, a magnetic memory, and/or an optical memory) that stores information, such as temperature threshold data, and/or instructions for use by the processor to perform the function. For example, when performing the function, controller 128 may receive a command to adjust a setting of screed assembly 104 and selectively cause the setting to be adjusted or prevent the setting from being adjusted based on a temperature of one or more components of screed assembly 104 (e.g., based on a temperature of one or more components of primary screed 106).

Sensor devices 130 may include one or more devices capable of generating signals regarding a temperature of one or more components of screed assembly 104. For example, sensor devices 130 may generate temperature data indicating the temperature of the one or more components of screed assembly 104. The one or more components may include left main frame 112, right main frame 114, and/or main screed plate 116, among other components of screed assembly 104. In some situations, sensor device 130 may be electrical temperature transducers. While FIG. 2 illustrates multiple sensor devices 130, in practice, there may be additional sensor devices 130, fewer sensor devices 130, different sensor devices 130, or differently arranged sensor devices 130 than those shown in FIG. 2.

In some implementations, sensor devices 130 may be provided on different locations of screed assembly 104. The locations may be locations that are optimal for capturing an accurate temperature reading of the one or more components of screed assembly 104. For example, sensor devices 130 may be provided on left main frame 112, on right main frame 114, on main screed plate 116, on lower frame 122, on screed plate 116, and/or on other portions of screed assembly 104 and/or of paving machine 102. For instance, sensor device 130-1 may be provided on left main frame 112 and sensor device 130-2 may be provided on right main frame 114. Sensor devices 130 may be provided on the different locations by welding, bolting, or other methods.

Sensor devices 130 may be electrically coupled to controller 128 via different channels or via a same channel. Sensor devices 130 may generate electric signals proportional to a temperature sensed at the locations mentioned above. In some examples, the temperature data may include or may be based on the electrical signals. Sensor devices 130 may generate the temperature data periodically (e.g., every ten minutes, every thirty minutes, every hour, among other examples). Additionally, or alternatively, sensor devices 130 may generate the temperature data periodically (e.g., every second, every five seconds, every ten seconds, among other examples). Additionally, or alternatively, sensor devices 130 may generate the temperature data based on a trigger (e.g., based on a request from controller 128).

In some implementations, controller 128 may receive a command to adjust a setting of screed assembly 104. For example, controller 128 may receive the command from the operator controls of screed assembly 104 and/or of paving machine 102. Additionally, controller 128 may receive the command from a user interface associated with screed assembly 104 and/or associated with paving machine 102. The operator controls and/or the user interface may be configured to permit an operator to provide different commands (e.g., the command to adjust the setting of screed assembly 104, a command to start a new paving operation, a command for screed assembly 104 and/or paving machine 102 to rest on a paving surface, among other examples).

In some implementations, the command to adjust the setting of screed assembly 104 may be a command to cause screed assembly 104 to transition from a current setting of screed assembly 104 to a preset setting of screed assembly 104. The current setting may be a neutral state (or a resting state) of screed assembly 104. Alternatively, the current setting may be another preset setting.

The preset setting of screed assembly 104 may include a setting associated with an angle of attack of screed assembly 104, a setting associated with a width of screed assembly 104, a setting associated with an angle of crown system 118 (e.g., a crown percentage), a height of screed assembly 104 with respect to the working surface, a vertical movement of screed support arm 132, or a setting associated with the thickness control screws, among other examples.

Based on receiving the command to adjust the setting of screed assembly 104, controller 128 may obtain the temperature data from one or more of sensor devices 130. Controller 128 may determine a temperature of the one or more components of screed assembly 104, based on the temperature data. For example, based on the temperature data, controller 128 may determine a temperature of left main frame 112, a temperature of right main frame 114, a temperature of main screed plate 116, among other examples.

Controller 128 may determine whether the temperature (of the one or more components) satisfies a temperature threshold. For example, controller 128 may compare the temperature (of the one or more components) and the temperature threshold to determine whether the temperature (of the one or more components) satisfies the temperature threshold.

In some situations, the temperature threshold may be based on the preset setting. For example, the temperature threshold may be based on a temperature of the one or more components when the preset setting was stored. In some examples, controller 128 may obtain the temperature threshold from one or more memories associated with controller 128. For instance, the one or more memories may store information identifying different temperature thresholds in association with information identifying different settings of the screed assembly. In this regard, controller 128 may obtain the temperature threshold based on information identifying the preset setting.

Controller 128 may prevent the setting from being adjusted based on determining that the temperature does not satisfy the temperature threshold. By preventing the setting from being adjusted in this manner, controller 128 may prevent a distortion (or a twisting) of the one or more components. In situations, controller 128 may provide, for display, setting prevention information. The setting prevention information may be provided to the user interface, to a device of the operator, to one or more devices that monitor an operation of the screed assembly (e.g., a back office system), among other examples.

In some instances, the setting prevention information may include information indicating that the temperature does not satisfy the temperature threshold, information indicating that the setting has not been adjusted based on the temperature not satisfying the temperature threshold, information identifying the one or more components associated with the temperature, among other information regarding the setting not being adjusted.

In some examples, controller 128 may determine an amount of time for the temperature to satisfy the temperature threshold. For instance, controller 128 may determine an amount of time for the temperature (of the one or more components) to increase and reach an operable temperature for screed assembly 104. Controller 128 may provide information indicating that the setting will be adjusted after the amount of time has elapsed. In some situations, the information may be included in the setting prevention information.

In some instances, controller 128 may determine the amount of time based on a current rate of temperate change associated with the one or more components. Additionally, or alternatively, controller 128 may determine the amount of time based on historical data. For example, the historical data may include a historical rate of temperature change of the one or more components (e.g., based on screed assembly 104 being in the current setting), historical amounts of time for the temperature of the one or more components to increase (e.g., based on screed assembly 104 being in the current setting), among other examples.

In some situations, controller 128 may determine that the temperature satisfies the temperature threshold. Based on determining that the temperature satisfies the temperature threshold, controller 128 may adjust the setting of screed assembly 104. For example, controller 128 may adjust the angle of attack of screed assembly 104, adjust the width of screed assembly 104, adjust the angle of crown system 118, adjust the height of screed assembly 104 with respect to the working surface, adjust the vertical movement of screed support arm 132, among other examples. In some situations, controller 128 may adjust the setting to adjust one or more characteristics of a material processed by screed assembly 104 and/or paving machine 102. For example, controller 128 may adjust the setting to adjust one or more of a thickness of the material, a texture of the material, a smoothness of the material, among other examples.

In some instances, controller 128 may provide information indicating that the setting has been adjusted. For example, controller 128 may provide the information to the user interface, to a device of the operator, to one or more devices that monitor an operation of the screed assembly (e.g., a back office system), among other examples.

The temperature threshold discussed herein may be a first temperature threshold. While the foregoing example has been described with respect to causing the setting to be adjusted based on the temperature of the one or more components satisfying the first temperature threshold, implementations described herein may be applicable to causing a setting to be adjusted based on the temperature not satisfying a second temperature threshold. The first temperature threshold may exceed the second temperature threshold.

As an example, controller 128 may selectively cause screed assembly 104 to transition from a current setting to the neutral state based on determining that the temperature does not satisfy the second temperature threshold. By way of explanation, in some situations, causing the screed assembly to transition to the neutral state prior to the temperature (of the one or more components) decreasing below the second temperature threshold may have a similar effect as causing screed assembly 104 to transition from the neutral state to the preset setting prior to the temperature of the one or more components satisfying the first temperature threshold.

Accordingly, controller 128 may cause screed assembly 104 to transition from a current setting to the neutral state based on determining that the temperature (of the one or more components) does not satisfy the second temperature threshold, in a manner similar to the manner described above. Alternatively, controller 128 may prevent screed assembly 104 from transitioning from a current setting to the neutral state based on determining that the temperature satisfies the second temperature threshold, in a manner similar to the manner described above.

In some implementations, a neutral setting may be configured to cause screed assembly 104 to return to a neutral state (e.g., return to the neutral state at the end of a workday). In some situations, in the neutral state, main screed plate 116 may be provided in a flat configuration when cooling down at the end of the workday instead of being provided in a twisted/distorted configuration when cooling down at the end of the workday. Cooling down in the twisted/distorted configuration may cause a fatigue impact on main screed plate 116. In this regard, implementations described herein may prevent main screed plate 116 from cooling down in the twisted/distorted configuration. In some examples, the neutral setting may be activated based on a manual selection. Alternatively, the neutral setting may be activated automatically (e.g., paving machine 102 shuts down). Movement of screed assembly 104 may be restricted based on a temperature of main screed plate 116 not satisfying a temperature threshold.

The number and arrangement of devices shown in FIG. 2 are provided as an example. In practice, there may be additional devices, fewer devices, different devices, or differently arranged devices than those shown in FIG. 2. Furthermore, two or more devices shown in FIG. 2 may be implemented within a single device, or a single device shown in FIG. 2 may be implemented as multiple, distributed devices. Additionally, or alternatively, a set of devices (e.g., one or more devices) of the example component may perform one or more functions described as being performed by another set of devices of the example component.

Figure 3:
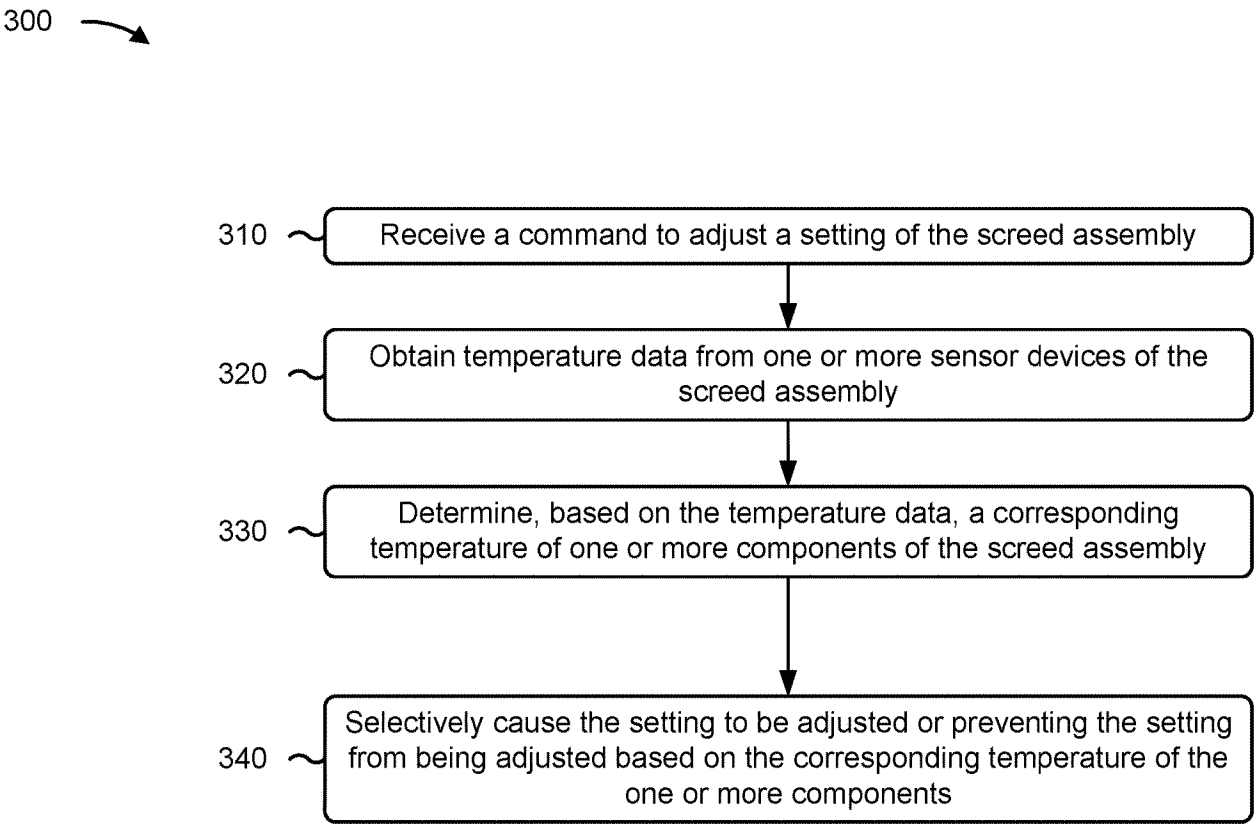
FIG. 3 is a flowchart of an example process adjusting a setting of a screed assembly.

FIG. 3 is a flowchart of an example process 300 associated with adjusting a setting of a screed assembly. In some implementations, one or more process blocks of FIG. 3 may be performed by a controller (e.g., controller 128). In some implementations, one or more process blocks of FIG. 3 may be performed by another device or a group of devices separate from or including the controller, such as one or more sensor devices (e.g., one or more sensor devices 130).

As shown in FIG. 3, process 300 may include receiving a command to adjust a setting of the screed assembly (block 310). For example, the controller may receive a command to adjust a setting of the screed assembly, as described above.

As further shown in FIG. 3, process 300 may include obtaining temperature data from one or more sensor devices of the screed assembly (block 320). For example, the controller may obtain temperature data from one or more sensor devices of the screed assembly, as described above.

As further shown in FIG. 3, process 300 may include determining, based on the temperature data, a corresponding temperature of one or more components of the screed assembly (block 330). For example, the controller may determine, based on the temperature data, a corresponding temperature of one or more components of the screed assembly, as described above.

As further shown in FIG. 3, process 300 may include selectively causing the setting to be adjusted or preventing the setting from being adjusted based on the corresponding temperature of the one or more components, the setting being adjusted based on determining that the corresponding temperature satisfies a temperature threshold, or the setting being prevented from being adjusted based on determining that the corresponding temperature does not satisfy the temperature threshold (block 340). For example, the controller may selectively cause the setting to be adjusted or preventing the setting from being adjusted based on the corresponding temperature of the one or more components, the setting being adjusted based on determining that the corresponding temperature satisfies a temperature threshold, or the setting being prevented from being adjusted based on determining that the corresponding temperature does not satisfy the temperature threshold, as described above.

In some situations, adjusting the setting includes causing the screed assembly to transition from a current setting to a preset setting.

In some implementations, process 300 includes providing, for display, setting prevention information, wherein the setting prevention information includes information indicating that the corresponding temperature does not satisfy the temperature threshold, and information indicating that the setting has not been adjusted based on the corresponding temperature not satisfying the temperature threshold.

In some implementations, the setting prevention information further includes information identifying the one or more components.

In some implementations, the one or more components include a main screed plate, and wherein determining the temperature of the one or more components of the screed assembly comprises determining the temperature of the main screed plate based on the temperature data.

In some implementations, the one or more components include at least one of a left main frame of a primary screed of the screed assembly or a right main frame of the primary screed, and wherein determining the temperature of the one or more components of the screed assembly comprises determining a corresponding temperature of the at least one of the left main frame or the right main frame based on the temperature data.

In some implementations, process 300 includes determining an amount of time for the temperature to satisfy the temperature threshold, and providing information indicating that the setting will be adjusted after the amount of time has elapsed.

In some implementations, selectively causing the setting to be adjusted or preventing the setting from being adjusted comprises determining that the temperature satisfies the temperature threshold, and adjusting one or more of an angle of attack of the screed assembly, or a width of the screed assembly, an angle of a crown system associated with the screed assembly (e.g., a crown percentage), a height of the screed assembly with respect to a working surface, a vertical movement of one or more screed support arms associated with the screed assembly.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

Implementations described herein relate to controlling an adjustment of a setting of a screed assembly based on a temperature of one or more components of the screed assembly. For example, the system may adjust the setting of the screed assembly based on determining that the temperature satisfies a temperature threshold. Alternatively, the system may prevent an adjustment of the setting based on determining that the temperature does not satisfy the temperature threshold.

Adjusting the setting of the screed assembly in this manner may prevent a distortion of a primary screed of the screed assembly (e.g., prevent a distortion of a left main frame, a right main frame, and/or a main screed plate). Accordingly, adjusting the setting of the screed assembly may be prevent premature wear of the screed assembly and/or prevent damage to the screed assembly that may occur when adjusting the setting of the screed assembly without consideration of the temperature of the one or more components.

What is claimed is:

1. A method performed by a controller of a screed assembly, the method comprising:
- receiving a command to adjust a setting of the screed assembly;
- obtaining temperature data from one or more sensor devices of the screed assembly;
- determining, based on the temperature data, a corresponding temperature of one or more components of the screed assembly; and
- selectively causing the setting to be adjusted or preventing the setting from being adjusted based on whether the corresponding temperature of the one or more components satisfies a temperature threshold.

2. The method of claim 1, further comprising:
- providing, for display, setting prevention information, wherein the setting prevention information includes:
  - information indicating that the corresponding temperature does not satisfy the temperature threshold,
  - information indicating that the setting has not been adjusted based on the corresponding temperature not satisfying the temperature threshold, and
  - information identifying the one or more components.

3. The method of claim 1,
- wherein adjusting the setting comprises:
  - causing the screed assembly to transition from a current setting to a preset setting.

4. The method of claim 1,
- wherein the one or more components include a main screed plate, and
  - wherein determining the corresponding temperature of the one or more components of the screed assembly comprises:
    - determining a temperature of the main screed plate based on the temperature data.

5. The method of claim 1,
- wherein the one or more components include at least one of a left main frame of a primary screed of the screed assembly or a right main frame of the primary screed, and
  - wherein determining the corresponding temperature of the one or more components of the screed assembly comprises:
    - determining the corresponding temperature of the at least one of the left main frame or the right main frame based on the temperature data.

6. The method of claim 1, further comprising:
- determining an amount of time for the corresponding temperature to satisfy the temperature threshold; and
- providing information indicating that the setting will be adjusted after the amount of time has elapsed.

7. The method of claim 1,
wherein selectively causing the setting to be adjusted or preventing the setting from being adjusted comprises:
determining that the corresponding temperature satisfies the temperature threshold; and
based on determining that the corresponding temperature satisfies the temperature threshold, adjusting one or more of:
an angle of attack of the screed assembly,
a width of the screed assembly,
an angle of a crown system associated with the screed assembly,
a height of the screed assembly with respect to a working surface,
a vertical movement of one or more screed support arms associated with the screed assembly.

8. A controller, comprising:
one or more memories; and
one or more processors, coupled to the one or more memories, configured to:
receive a command to adjust a setting for operating a screed assembly of a machine;
determine a corresponding temperature of one or more components of the screed assembly;
determine whether the corresponding temperature satisfies a temperature threshold; and
selectively cause the setting to be adjusted or prevent the setting from being adjusted based on whether the corresponding temperature satisfies the temperature threshold,
the setting being adjusted based on determining that the corresponding temperature satisfies the temperature threshold, or
the setting being prevented from being adjusted based on determining that the corresponding temperature does not satisfy the temperature threshold.

9. The controller of claim 8,
wherein the machine is a paving machine, and
wherein, to selectively cause the setting to be adjusted or prevent the setting from being adjusted, the one or more processors are configured to:
determine that the corresponding temperature satisfies the temperature threshold; and
based on determining that the corresponding temperature satisfies the temperature threshold, adjust the setting to adjust one or more of a thickness of a material processed by the machine, a texture of the material, or a smoothness of the material.

10. The controller of claim 8, wherein, to selectively cause the setting to be adjusted or prevent the setting from being adjusted, the one or more processors are further configured to:
provide setting prevention information,
wherein the setting prevention information includes one or more of:
information indicating that the corresponding temperature does not satisfy the temperature threshold, or
information indicating that the corresponding temperature, not satisfying the temperature threshold, prevents the setting from being adjusted.

11. The controller of claim 10,
wherein the one or more processors are configured to:
provide the setting prevention information to one or more devices that monitor an operation of the screed assembly.

12. The controller of claim 10,
wherein the one or more processors are configured to:
determine an amount of time for the corresponding temperature to satisfy the temperature threshold; and
wherein the setting prevention information further includes information indicating that the setting will be adjusted after the amount of time has elapsed.

13. The controller of claim 8, wherein, to determine the corresponding temperature of the one or more components, the one or more processors are further configured to:
obtain temperature data from one or more sensor devices associated with the screed assembly; and
at least one of:
determine a temperature of a main screed plate, of the one or more components, based on the temperature data, or
determine a corresponding temperature of a left main frame or a right main frame, of the one or more components, based on the temperature data.

14. The controller of claim 8, wherein, to adjust the setting, the one or more processors are further configured to:
causing the screed assembly to transition from a current setting to a preset setting.

15. A screed assembly, comprising:
one or more sensor devices configured to generate temperature data indicating a corresponding temperature of one or more components of the screed assembly; and
a controller configured to:
receive a command to adjust a setting for operating the screed assembly;
determine the corresponding temperature of the one or more components based on the temperature data; and
selectively adjust the setting or prevent the setting from being adjusted based on whether the corresponding temperature of the one or more components is a first value or a second value that is different than the first value.

16. The screed assembly of claim 15,
wherein the first value satisfies a temperature threshold, and
wherein the second value does not satisfy the temperature threshold.

17. The screed assembly of claim 15,
wherein the one or more components further comprises a main screed plate, and
wherein, to determine the corresponding temperature of the one or more components, the controller is further configured to:
determine a temperature of the main screed plate based on the temperature data.

18. The screed assembly of claim 15,
wherein the one or more components further comprises at least one of a left main frame or a right main frame, and
wherein, to determine the corresponding temperature of the one or more components, the controller is further configured to:
determine the corresponding temperature of the at least one of the left main frame or the right main frame based on the temperature data.

19. The screed assembly of claim 15, wherein, to selectively cause the setting to be adjusted or prevent the setting from being adjusted, the controller is further configured to:
provide setting prevention information,
wherein the setting prevention information includes one or more of:

information indicating that the corresponding temperature prevents the setting from being adjusted, or information identifying the one or more components.

20. The screed assembly of claim 15, wherein the screed assembly is associated with a machine, and wherein, to selectively cause the setting to be adjusted or prevent the setting from being adjusted, the controller is further configured to:

determine that the corresponding temperature satisfies a temperature threshold; and based on determining that the corresponding temperature satisfies the temperature threshold, adjust the setting to adjust one or more characteristics of a material processed by the machine.

* * * * *